United States Patent [19]

Mettig et al.

[11] 4,253,431

[45] Mar. 3, 1981

[54] RECIPROCATING PISTON INTERNAL COMBUSTION ENGINE WITH AT LEAST ONE CYLINDER BUSHING

[75] Inventors: Hermann Mettig, Cologne; Rudolf Jeschar, Clausthal-Zellerfeld, both of Fed. Rep. of Germany

[73] Assignee: Klöckner-Humboldt-Deutz Aktiengesellschaft, Cologne, Fed. Rep. of Germany

[21] Appl. No.: 927,884

[22] Filed: Jul. 25, 1978

[51] Int. Cl.[3] ..... F02F 1/10

[52] U.S. Cl. ..... 123/41.72; 123/41.31; 123/41.2; 123/41.84; 165/105

[58] Field of Search ..... 123/41.2, 41.16, 41.31, 123/41.42, 41.71, 41.72, 41.79, 41.81, 41.83, 41.84, 193 C, 188 A, 188 AA; 165/51, 105

[56] References Cited

U.S. PATENT DOCUMENTS

| | | | |
|---|---|---|---|
| 1,616,941 | 2/1927 | Woolson | 123/41.71 |
| 2,736,300 | 2/1956 | Flynn | 123/41.31 |
| 3,701,342 | 10/1972 | Owsley et al. | 123/41.16 |
| 3,731,660 | 5/1973 | Leffert | 123/41.42 |
| 3,822,680 | 7/1974 | Showalter et al. | 123/41.2 |
| 3,838,668 | 10/1974 | Hays et al. | 165/105 |
| 3,945,353 | 3/1976 | Dreisin | 123/41.31 |
| 4,013,047 | 3/1977 | Harned | 123/41.31 |

FOREIGN PATENT DOCUMENTS

| | | | |
|---|---|---|---|
| 2242947 | 3/1974 | Fed. Rep. of Germany | 123/41.2 |
| 1187167 | 3/1959 | France | 123/41.84 |
| 705869 | 3/1954 | United Kingdom | 123/41.84 |

*Primary Examiner*—Charles J. Myhre
*Assistant Examiner*—W. Wolfe
*Attorney, Agent, or Firm*—Becker & Becker, Inc.

[57] ABSTRACT

A reciprocating piston internal combustion engine having an engine frame with at least one cylinder bushing inserted therein which bushing with the engine frame forms a cooling water receiving chamber or jacket surrounding the cylinder bushing. One end, with an upright cylinder the upper end, of the bushing rests by means of an axial and/or radial collar on the engine frame. The cylinder bushing has operatively associated therewith a heat jacket having a wall portion thereof in contact with cooling water in the interior of the cooling water receiving chamber. The heat jacket which may be in the form of a flat annular tube or pipe extends from the region of the cooling water receiving chamber to at least near, preferably into the collar. The interior of the heat jacket is advantageously so designed, e.g. has a capillary design, that the liquid heat carrier in the heat jacket will also be able to flow against the force of gravity in the longitudinal direction of the cylinder bushing.

4 Claims, 6 Drawing Figures

RECIPROCATING PISTON INTERNAL COMBUSTION ENGINE WITH AT LEAST ONE CYLINDER BUSHING

The present invention relates to a reciprocating piston internal combustion engine with at least one cylinder bushing or liner which is inserted into a machine frame and together with the latter forms a cooling water chamber, and at the upper end rests on a machine frame by means of an axial or, if desired, radial collar.

Within the region of the collar of the cylinder bushing adjacent to which there is provided the cylinder head, in view of the combustion, a rather great quantity of heat occurs. It is, however, just within this region not possible for reason of strength to provide a sufficiently large water jacket. In order to improve the heat withdrawal, the bushing collar has been provided with bores through which cooling water flows or with different cooling rings. Such constructions are expensive and nevertheless not entirely satisfactory because the collar region which is under considerable stress is in view of these stresses considerably affected as to its strength.

It is, therefore, an object of the present invention to provide a reciprocating piston internal combustion engine in which the above mentioned drawbacks will be remedied, and a good heat withdrawal will be assured in the upper region of the bushing adjacent said collar while the strength of the cylinder bushing will not be affected.

These and other objects and advantages of the invention will appear more clearly from the following specification in connection with the accompanying drawings, in which.

Figure 1:
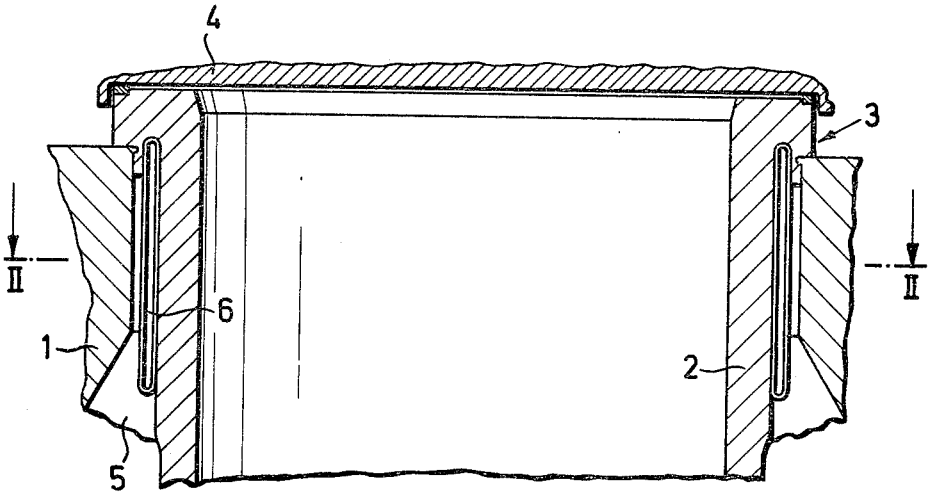
FIG. 1 represents a fragmentary longitudinal section through a cylinder bushing, a machine frame and a mantle-shaped heat pipe.

The reciprocating piston internal combustion engine according to the present invention is characterized primarily in that the cylinder bushing is operatively connected with a substantially mantle-shaped heat pipe which extends from the cooling water chamber to or into the collar, while the interior of the heat pipe comprises means, for instance a capillary structure, which permits the transport of a liquid heat carrier also against the force of gravity along the cylinder bushing.

The heat pipe may form one mantle-shaped piece, and may surround the cylinder bushing. For the design of the heat pipe, it is advantageous to provide a plurality of partially mantle-shaped heat pipe sectors which are aligned one adjacent the other and surround the cylinder bushing. In view of the mantle-shaped water pipe or pipes surrounding the cylinder bushing, the heat quantity forming in particular within the region of the collar can be transferred into a region of the cooling water chamber in which the heat in view of the greater continuously removed quantity of water can be withdrawn. Due to this design, the entire circumference of the cylinder bushing will be uniformly cooled so that no heat tension problems are encountered. Also the relative movement between the collar and the machine frame as caused by differences in temperature will be considerably reduced in this way. Depending on the use, it may be necessary to arrange a plurality of heat pipe rings in the longitudinal direction of the cylinder pipe one behind the other. Such heat pipe rings consist of a single mantle-shaped heat pipe or a plurality of partially mantle-shaped heat pipe sectors.

Heat pipes per se are known for instance by way of the article "The Heat Pipe—A Building Element in Heating and Cooling Technique" by M. Groll and D. Keser appearing in the German magazine "Die Kälte", No. 6/1974, Pages 210–224 ("Das Wärmerohr- ein neuartiges Bauelement in der Wärme- und Kältetechnik"). The heat pipes described therein are designed as pear-shaped hollow bodies which are air emptied and partially filled with a liquid whereby the liquid at one end will evaporate in view of heat supply and at the other end will condense in view of heat withdrawal. It is also known to provide the inner wall of these pipes with a capillary structure so that the heat carrier can be transported against the force of gravity.

According to the above mentioned article, however, these pipes are suggested in the heating and air conditioning art for heat exchangers and are employed in a completely unrelated field. Therefore, the above article does not furnish any hints to a solution of the problems underlying the present invention, particularly also in view of the fact that the heat pipes referred to in the above mentioned article cannot be used in internal combustion engines.

According to a further development of the present invention, it is suggested that the wall of the cylinder bushing comprises at least one mantle-shaped chamber which is designed as heat pipe. Inasmuch as the cylinder bushing is heated from the inside, and its outer region is in communication with cooling water, it is advantageous to design the mean diameter of said chamber which is designed as pipe, shorter in the collar region than in the remaining region and more specifically so that the diameter increases in the direction of the increase in the cooling water chamber so that it will be closer to the cooling water. The chamber may be formed by a two-sectional cylinder bushing, i.e. a cylinder bushing as shown in FIGS. 1–5 and a sleeve surrounding said bushing. Bushing and sleeve must of course be sealingly connected in order to correspond to the conditions of a heat pipe. The sealing connection between sleeve and cylinder bushing may be effected for instance by electron beam welding because such welding is carried out in a vacuum so that the evacuation of said chamber will be created at the same time in conformity with the requirements of a heat pipe.

Referring now to the drawings in detail, FIGS. 1–6 show a machine frame 1 of a reciprocating piston internal combustion engine in which cylinder bushing 2 is inserted which is provided with a collar 3. Adjacent the collar 3 of the cylinder bushing 2 there is provided a partially shown cylinder head 4 which by means of non-illustrated ties is connected to the machine frame 1. Between the machine frame 1 and the cylinder bushing 2 there is provided a cooling water chamber 5 adapted to receive and release a cooling medium.

Figure 2:
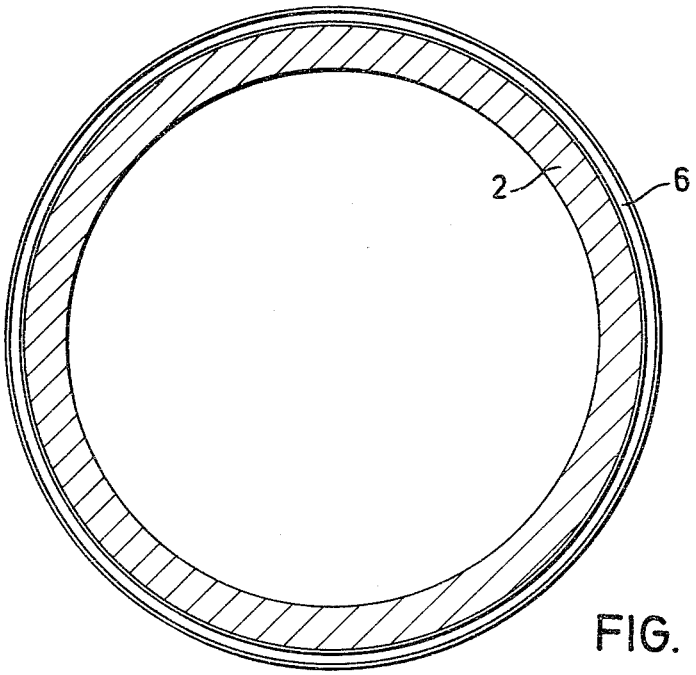
FIG. 2 is a cross section through the cylinder bushing and the heat pipe of FIG. 1, said section being taken along the line II—II of FIG. 1.

According to the embodiment shown in FIGS. 1 and 2, the upper region of the cylinder bushing 2 is surrounded by a one-piece mantle-shaped heat pipe 6 which extends from the cooling water chamber 5 into the collar 3.

According to the embodiment shown in FIGS. 1 and 2, the upper region of the cylinder bushing 2 is surrounded by a one-piece mantle-shaped heat pipe 6 which extends from the cooling water chamber 5 into the collar 3.

Figure 3:
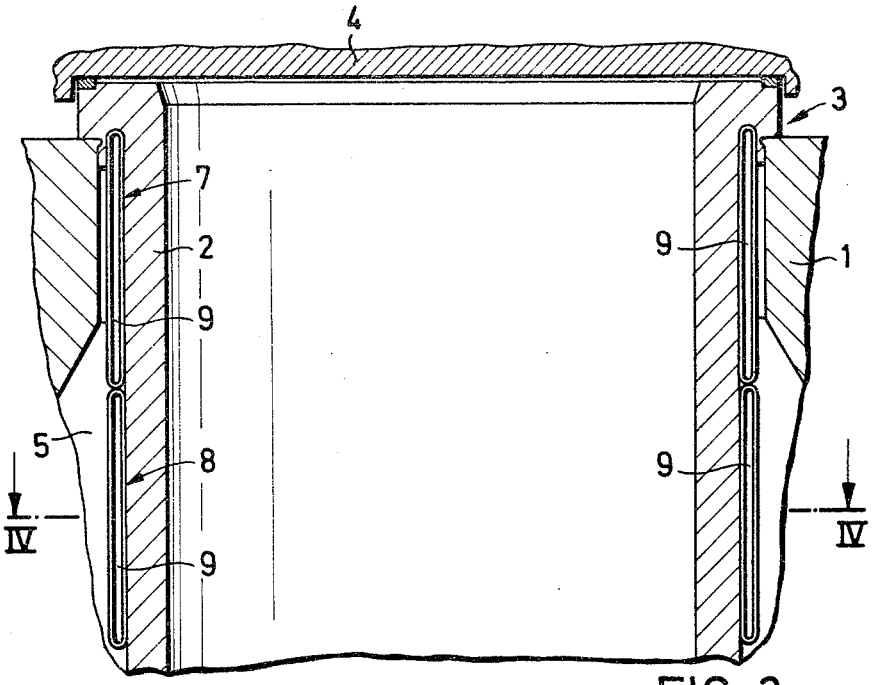
FIG. 3 represents a fragmentary longitudinal section through a machine frame and a cylinder bushing with a plurality of mantle-shaped heat pipes which are arranged in two heat pipe rings arranged one behind the other.
Figure 4:
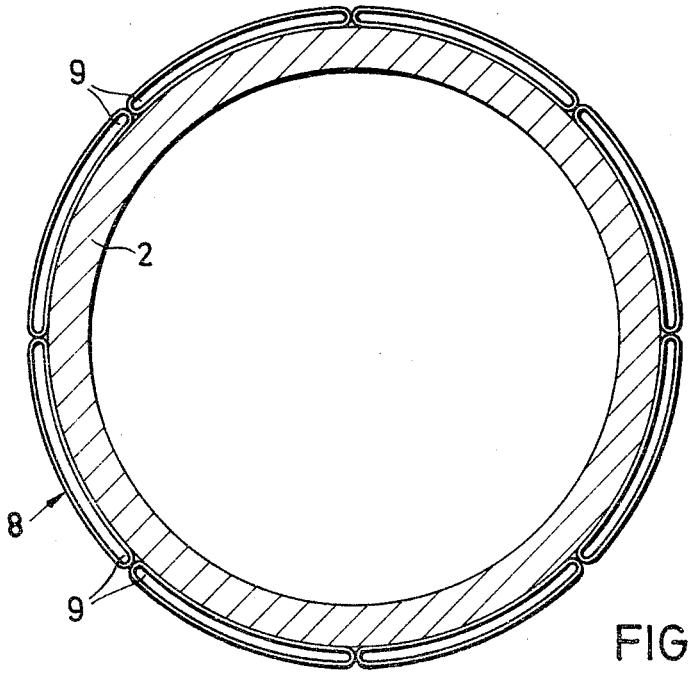
FIG. 4 represents a cross section through the cylinder bushing and the lower heat pipe sectors, said section being taken along the line IV—IV of FIG. 3.

According to the embodiment of FIGS. 3 and 4, two heat pipe rings 7 and 8 are provided which are composed of individually partially mantle-shaped heat pipe sectors 9.

Figure 5:
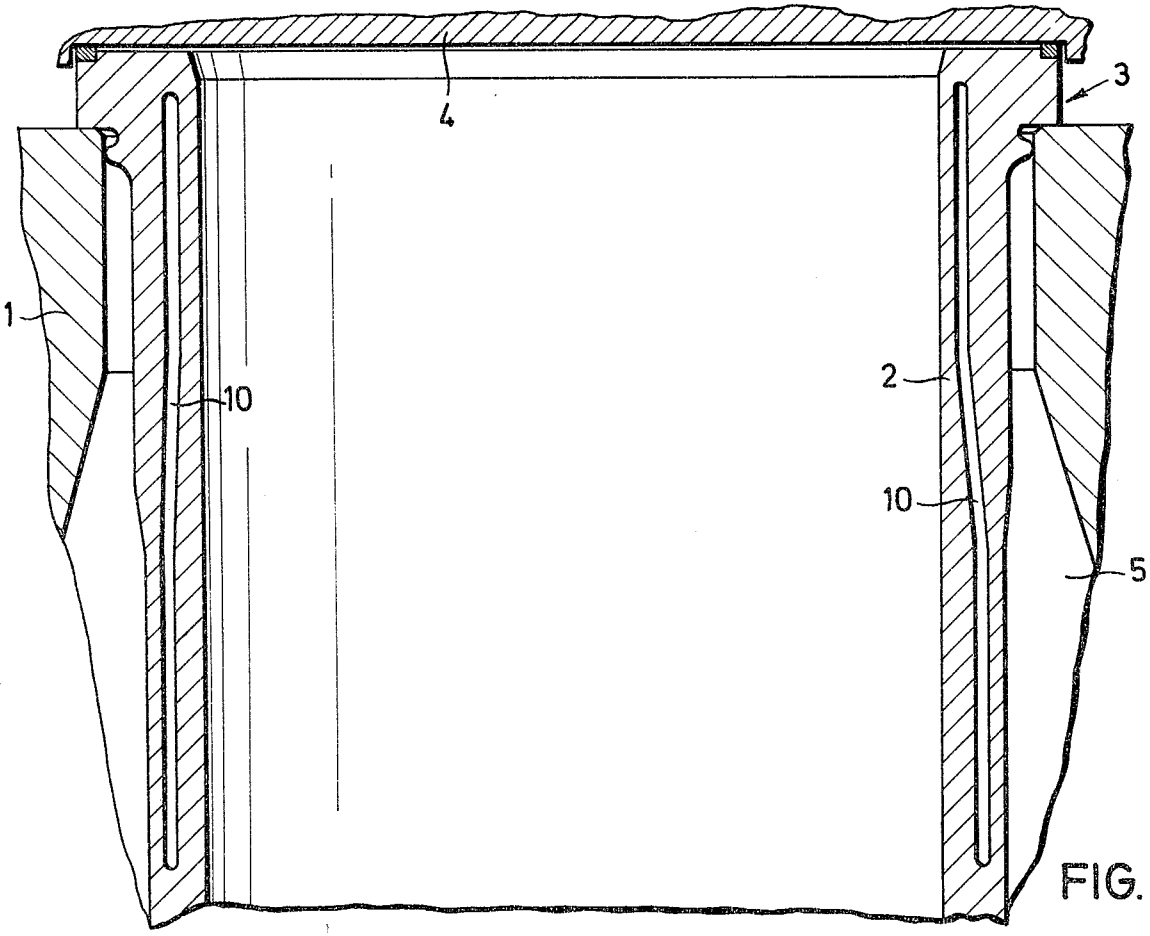
FIG. 5 represents a fragmentary longitudinal section through a machine frame and a cylinder bushing while the cylinder bushing comprises a chamber acting as heat pipe.
Figure 6:
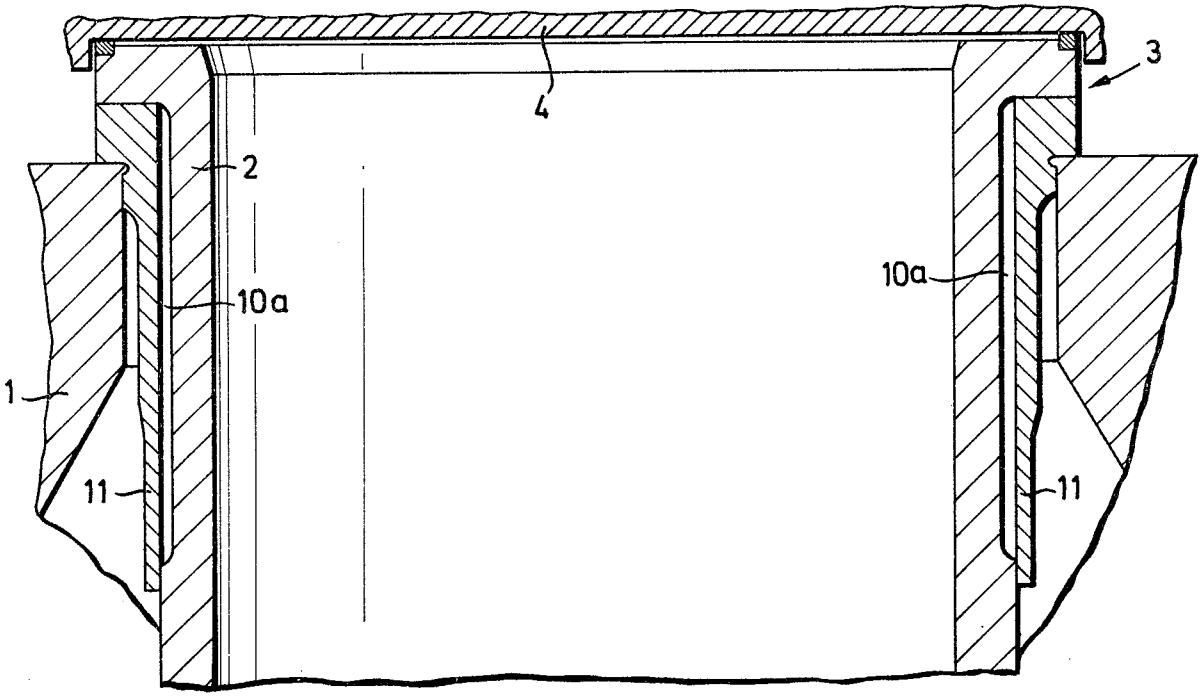
FIG. 6 illustrates a fragmentary section similar to FIG. 5 while, however, the chamber forming the heat pipe is formed by a two-sectional cylinder bushing.

According to the embodiment of FIG. 5, the cylinder bushing has a chamber 10 which is designed as heat pipe and the mean diameter of which increases from the cylinder bushing collar 3 in the direction toward the cooling water chamber 5 so that the chamber within the region of the collar is near to the inner wall, and within the region of the cooling water chamber is near the outer wall, whereby the temperature difference within the chamber and thus within the heat pipe is increased. The chamber 10 may in the same manner be produced as the one mentioned in FIG. 6 which will now be described. The chamber 10*a* in FIG. 6, which chamber is likewise designed as heat pipe, is formed by a two-sectional bushing, namely the bushing section 2 and the bushing section 11 forming a sleeve and surrounding the bushing section 2. Both bushing sections 2 and 11 are connected to each other for instance by electron beam welding. In order to assure that the chamber 10*a* can extend far into the region of the collar 3, the sleeve 11 has a collar-formed shoulder by means of which the cylinder bushing can be inserted in the machine frame. In view of the design and arrangement of the heat pipes around the cylinder bushing, it is possible to distribute the heat in an isothermal way over the cylinder bushing.

It is, of course, to be understood that the present invention is by no means limited to the specific showing in the drawings, but also comprises any modifications within the scope of the appended claims. Thus, it is to be understood that the chambers 10 or 10*a* and the heat pipes 6 and 9 and the heat pipe rings 7 and 8 may be so designed that the entire length of the cylinder bushing is designed as heat pipe in which instance the maximum temperature differences between the hottest area of the cylinder bushing and the coldest water can be taken advantage of.

What we claim is:

1. A water cooled reciprocating piston internal combustion engine which includes: an engine frame, a cylinder bushing inserted in said engine frame and having one end provided with a collar and being supported by said engine frame, said bushing together with said engine frame defining an annular chamber adapted to receive cooling water, a mantle-formed heat jacket arranged with said cylinder bushing and having a wall portion defining an inner surface and an outer surface thereof arranged for contact with the content of said annular chamber, said heat jacket extending from the cooling water chamber, said at least into the vicinity of said collar and while being arranged to receive and keep contained a liquid heat carrier therein having its inner surface arranged as means to create a capillary effect internally to permit such liquid heat carrier in said heat jacket to flow therein against the force of gravity in the longitudinal direction of and along said cylinder bushing for improved heat dissipation in the upper thermally highly loaded region of the bushing which must be cooled intensively so that rigidity and strength of the cylinder bushing is uninfluenced, wherein substantially all of said inner surface rests against said bushing and said outer surface projects into said cooling water chamber that receives cooling water.

2. A reciprocating piston internal combustion engine according to claim 1, in which said heat jacket comprises a single integral piece formed by an annular flat heat pipe nested in said annular chamber and surrounding said bushing.

3. A reciprocating piston internal combustion engine according to claim 1, in which said heat jacket comprises a plurality of annularly arranged curved flat pipe sectors engaging complementary to each other end to end while surrounding said bushing.

4. A reciprocating piston internal combustion engine according to claim 1, in which said heat jacket comprises a plurality of flat heat pipe rings arranged complementary one behind the other when viewed in the longitudinal direction of said bushing.

* * * * *

UNITED STATES PATENT AND TRADEMARK OFFICE

CERTIFICATE OF CORRECTION

PATENT NO. : 4,253,431

DATED : 3 March 1981

INVENTOR(S) : HERMANN METTIG ET AL

It is certified that error appears in the above—identified patent and that said Letters Patent is hereby corrected as shown below:

On the Title-Abstract Page: Please insert the following:

[30] Foreign Application priority data:

July 29, 1977 [DE] Fed. Rep. of Germany...2734254

Signed and Sealed this

Ninth Day of November 1982

[SEAL]

*Attest:*

GERALD J. MOSSINGHOFF

*Attesting Officer* *Commissioner of Patents and Trademarks*